United States Patent [19]

Bixby, Jr. et al.

[11] 4,405,292

[45] Sep. 20, 1983

[54] PNEUMATICALLY CONTROLLED RATE PUMP

[75] Inventors: Willard W. Bixby, Jr., LaCanada, Calif.; Jerry Christopher, Houston, Tex.

[73] Assignee: Haskel, Incorporated, Burbank, Calif.

[21] Appl. No.: 319,716

[22] Filed: Nov. 9, 1981

[51] Int. Cl.[3] ..... F04B 17/00

[52] U.S. Cl. ..... 417/403; 91/38; 91/219; 91/307; 137/624.14

[58] Field of Search ..... 417/397, 401, 402, 403, 417/404; 91/38, 219, 313, 307, 40; 137/624.14

[56] References Cited

U.S. PATENT DOCUMENTS

| | | | |
|---|---|---|---|
| 3,174,409 | 3/1965 | Hill | 417/403 X |
| 3,516,763 | 6/1970 | Manton | 417/403 |
| 3,590,582 | 7/1971 | German | 137/624.14 |
| 3,604,415 | 9/1971 | Hoenig | 137/624.14 |
| 3,872,876 | 3/1975 | Bachman | 91/38 X |
| 4,354,524 | 10/1982 | Higgins | 137/624.14 |

*Primary Examiner*—Leonard E. Smith

*Attorney, Agent, or Firm*—Fulwider, Patton, Rieber, Lee & Utecht

[57] ABSTRACT

A pneumatic pump includes a pneumatic cycling mechanism that permits the commencement of each successive pumping interval only upon the appearance of a pilot signal. The pilot signal is generated by a pneumatically operated pump timer that determines the pumping interval. The pilot signal is terminated during the pumping interval after a signal timer has timed out. The pump, timers and other pneumatic circuit elements are driven by the same source that powers the pump, and no reference to an externally generated timing signal is required.

17 Claims, 5 Drawing Figures

PNEUMATICALLY CONTROLLED RATE PUMP

FIELD OF THE INVENTION

The present invention relates to pumps, and, more particularly, to pneumatic pumps that can be operated at a controlled rate.

BACKGROUND OF THE INVENTION

Pumps of the reciprocating type have the inherent advantage of pumping the same known quantity of fluid during each operating cycle, this quantity being simply determined by the pumping chamber volume displaced by a piston. The pumping rate of such pumps can be controlled with considerable accuracy by controlling the frequency with which the pumping cycle is repeated. Accordingly, electrically operated reciprocating fluid pumps are well suited for use as rate pumps, i.e., pumps that are employed to pump fluid at a precisely controlled quantity per unit of time.

Although electrically driven reciprocating rate pumps are generally satisfactory, there are situations in which they are not suitable for use. For example, some rate pumps are operated in highly explosive environments where the presence of electrical equipment is undesirable, perhaps even totally prohibited. In some situations, pneumatic pumps are driven by compressed natural gas instead of air, making the presence of electrical equipment a potential hazard for that reason. It may then become necessary to rely on pneumatically operated pumps that do not so readily facilitate accurate control of the pumping rate.

Some hydraulic pumps, such as that described in U.S. Pat. No. 3,179,409 to Hill, have been converted to a hybrid type of apparatus in which the driving force is provided pneumatically but the pump is timed and controlled by an electrical circuit that causes a pneumatic control signal to be applied to a valve that in turn causes the pump to begin the next cycle of its operation. Purely pneumatic rate pumps have been built in which the air that provides the driving force is interrupted periodically, but the size of such pumps is severely limited because of the inability of the pneumatic controls to handle large volumes of air.

An objective of the present invention is to provide a pneumatically driven pump that is rate controlled by an entirely pneumatic mechanism.

SUMMARY OF THE INVENTION

The above objectives are accomplished with the use of a pump, which by itself has been known previously. This pump includes a pumping chamber, inlet and outlet valves associated with the pumping chamber, a pumping piston reciprocable within the pumping chamber to pump fluid into and out of the chamber, an actuation chamber, an actuation piston reciprocable within the actuation chamber and connected to the pumping piston for movement therewith, a primary inlet for admitting a pressurized operating gas to the actuation chamber, and a pneumatic cycling mechanism for causing the actuation piston to commence a new cycle of movement within the actuation chamber upon the application thereto of a pilot signal. The beginning of each pumping interval is thus designated by the appearance of the pilot signal, the pump completing one cycle during that interval and then pausing for the remainder of that interval.

A pneumatically operated pump timer measures predetermined pumping intervals and initiates a pilot signal at the conclusion of each such interval. At the end of the interval, a pneumatically operated circuit resets the pump timer. Both the pump timer and the signal timer may be of the volume chamber type.

In accordance with the preferred embodiment of the invention, a pilot signal presentation mechanism is included for presenting the pilot signal to the cycling mechanism upon the appearance of a pump cycle signal from the pump timer. This signal presentation mechanism may include a pneumatic memory and a pneumatic S-R (set-reset) gate to which the memory is responsive.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figure 1:
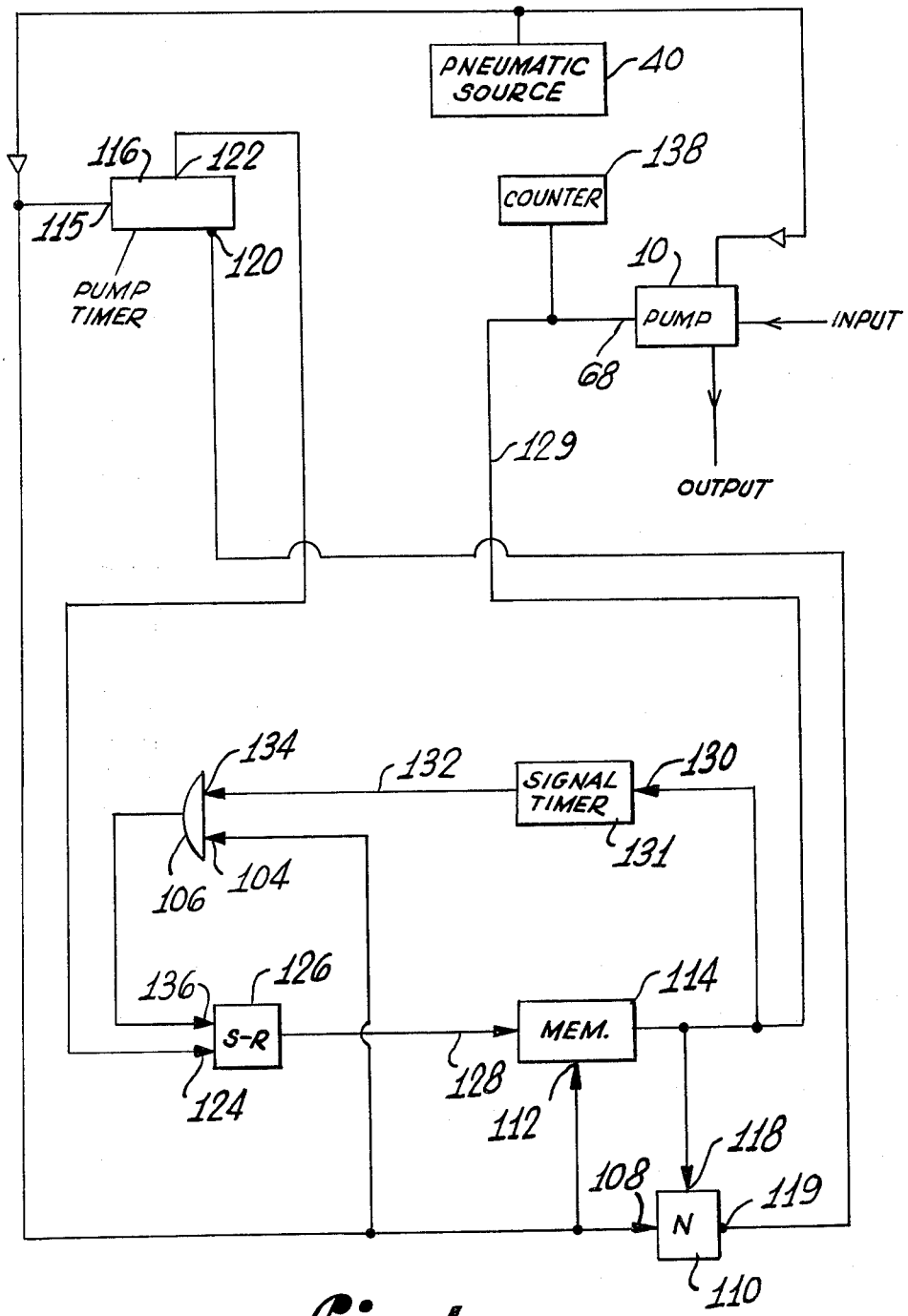
FIG. 1 is a schematic illustration of a pneumatic pumping apparatus that embodies the present invention.

The present invention is explained with reference to an illustrative pneumatic pump 10 of the reciprocating type, shown in FIGS. 2–5. A similar pump, although not a rate pump, is described in greater detail in U.S. Pat. No. 3,174,409 to Hill, which is incorporated by reference. The pump described in the Hill patent differs from the pump 10 primarily in that it employs two pilot valves whereas the pump 10 has only one.

The exemplary pump 10 includes a pumping chamber 12 in which a fluid to be pumped enters through an inlet check valve 14 and exits through an outlet check valve 16. A fluid piston 18 reciprocates within an upward extension 20 of the T-shaped pumping chamber 12. Thus when the piston 18 moves upwardly (with respect to the drawings) out of the chamber 12, fluid is drawn in through the inlet valve 14. When the piston 18 descends into the chamber 12, a portion of the chamber volume is displaced by the piston and an equivalent volume of fluid is expelled through the outlet valve 16. The amount of fluid expelled on each complete cycle of the piston 18 is predetermined, regardless of the speed at which the pump 10 is operated.

Connected to the upper end of the fluid piston 18 is a larger actuation piston 22 which an operating gas causes to reciprocate within a cylindrical actuation chamber 24. Movement of the actuation piston 22 is controlled by a pneumatic cycling mechanism 26 that includes a control valve 28 and a pilot valve 30.

The control valve 28 employs an elongated spool 34 that reciprocates to provide the movement of the actuation piston 22, confined by a bore 35 in an extended base structure 36 that is integrally formed with a housing 38 that defines the actuation chamber 24. Compressed air or other operating gas from the pneumatic source 40 (FIG. 1) enters the bore 35 through a primary inlet 42. Depending upon the axial position of the spool 34, the compressed air can enter the top of the actuation chamber 24 through an upper passage 44 or it can enter the bottom of the actuation chamber through a lower passage 46.

The pilot valve 30 is located at the top of actuation chamber 24. A spring 48 biases the pilot valve 30 toward a closed position (FIGS. 3–5) in which a stem 50 extends downwardly into the chamber 24 to be engaged by the actuation piston 22 when the fluid piston 18 is fully withdrawn from the pumping chamber 12 (as shown in FIG. 2).

Figure 2:
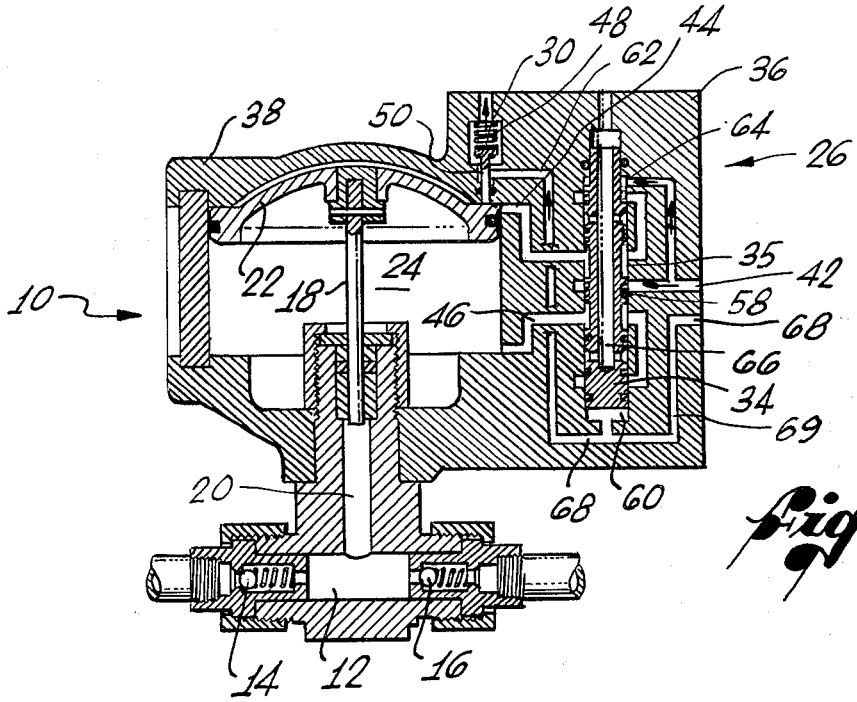
FIG. 2 is a cross-sectional view of the pump per se of FIG. 1 with the fluid piston fully withdrawn from the pumping chamber and the first pilot valve open.

Operation of the pump 10 is best understood by first observing the pump with the actuation piston 22 at the top of the actuation chamber 24 and with the fluid piston 18 fully withdrawn from the fluid chamber 12 (see FIG. 2). The pilot valve 30 is thus held open. The pneumatic source 40 communicates with the chamber 24 beneath the actuation piston 22 through the lower conduit 46, as long as an enlarged seal portion 58 at the center of the spool 34 remains above the inlet 42.

A lower chamber 60 defined by the bottom of the bore 35 beneath the spool 34 is evacuated through the pilot valve 30 via a depressurizing conduit 62 formed in the base structure 36. Alternatively, the pilot valve 30 could be omitted and the lower chamber evacuated through the pilot conduit 69. Once the lower chamber 60 has been depressurized, the spool 34 is forced downwardly within the bore 35 by the constant air pressure applied to an annular upper chamber 64 that surrounds the spool above its seal portion 58.

Figure 3:
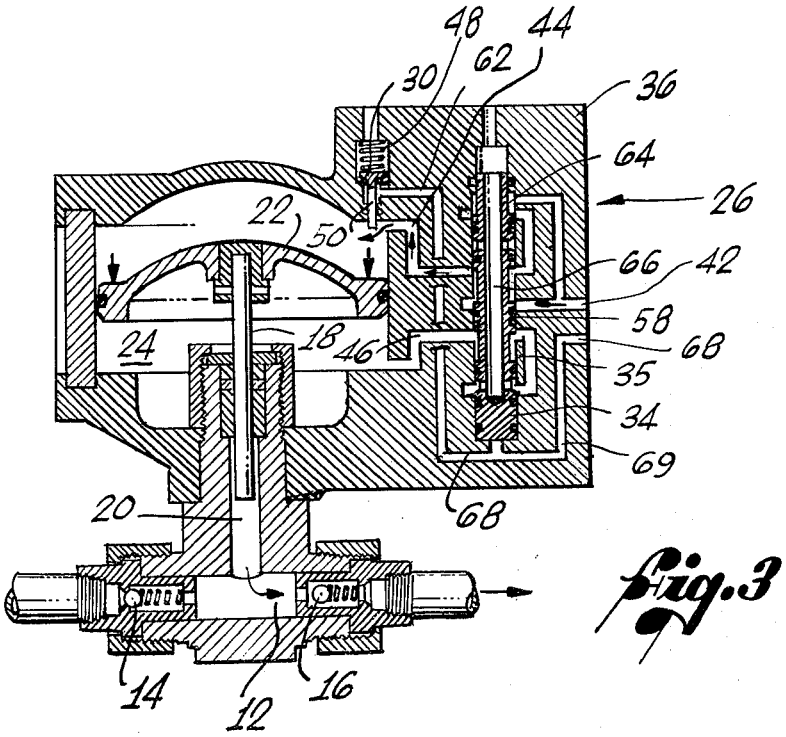
FIG. 3 is a cross-sectional view of the pump while the pumping piston is descending into the pumping chamber.

After the seal portion 58 has passed the inlet 42, the pneumatic source 40 is blocked against further communication with the bottom of the actuation chamber 24 through the lower conduit 46. Instead it communicates with the top of the chamber 24 through the upper conduit 44. The actuation piston 22 and fluid piston 18 are thus forced downwardly as air enters the top of the actuation chamber 24, as indicated in FIG. 3. The portion of the chamber 24 beneath the actuation piston 22 is evacuated through the lower conduit 46 and through an axial bore 66 in the spool 34.

Figure 4:
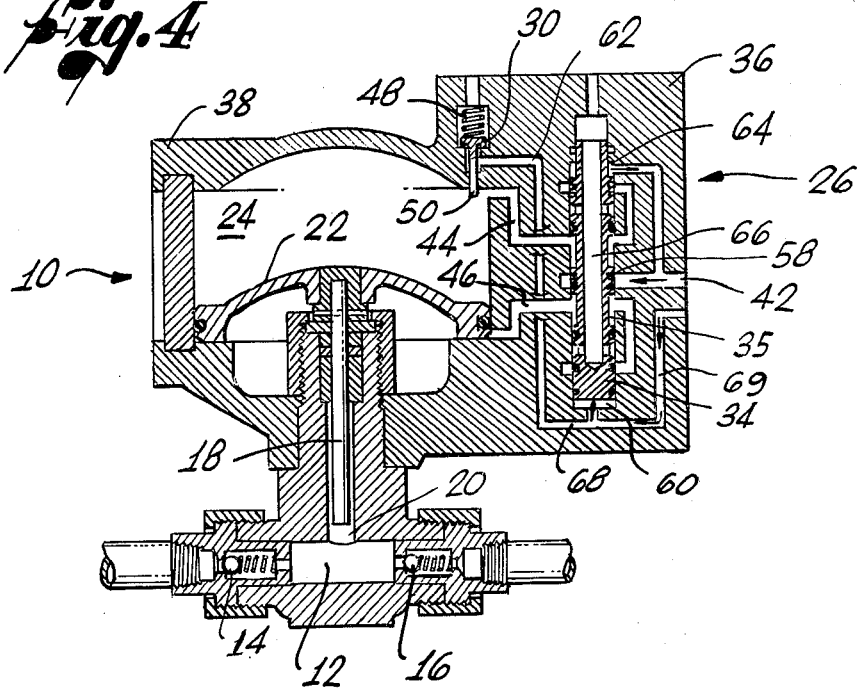
FIG. 4 is another cross-sectional view showing the pump with the pumping piston fully inserted in the pumping chamber.
Figure 5:
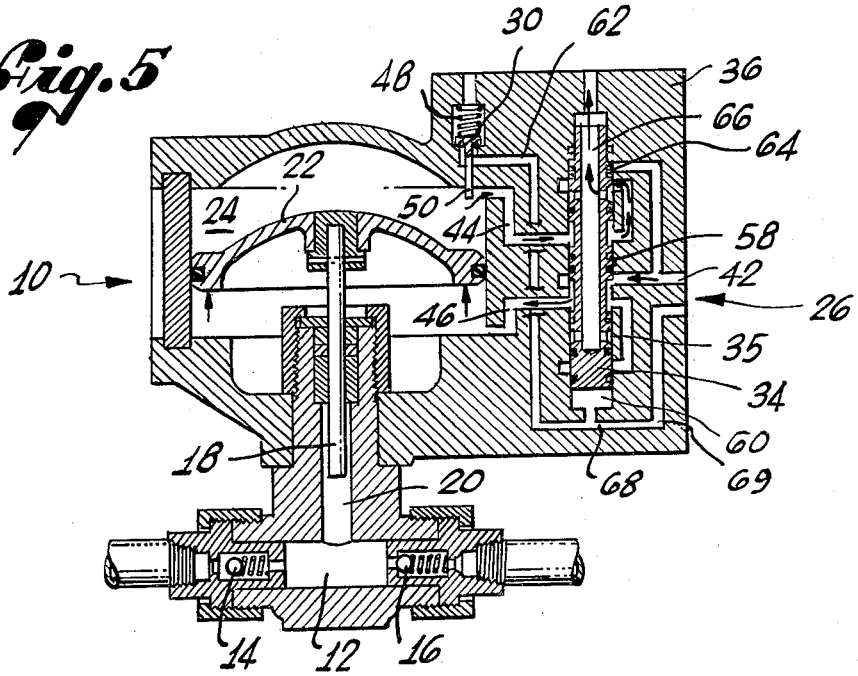
FIG. 5 is another cross-sectional view showing the pumping piston being withdrawn from the pumping chamber.

When the actuation piston 22 reaches the bottom of the chamber 24 (as shown in FIG. 4), it comes to rest until air (in the form of a pilot signal) is supplied to the bottom of the bore 35 beneath the spool 34 through a secondary inlet 68 and a pilot conduit 69. The spool 34 then moves upwardly with the bore 35 as the lower chamber 60 is repressurized (as shown in FIG. 5). Although the pressure in the annular upper chamber 64 resists upward movement of the spool 34, the upper chamber has a smaller cross-sectional area than the lower chamber 60 and the force exerted in the lower chamber prevails. Compressed air from the source 40 therefore enters the actuation chamber 24 beneath the piston 22 while the portion of the chamber above the piston is evacuated through the upper conduit 44 and the bore 66 of the spool 34.

The reciprocation rate of the pumping piston 22 of the pump 10 is accurately controllable, in accordance with this invention, by an external pneumatic circuit illustrated schematically in FIG. 1 that produces the pilot signal. Air pressure is constantly supplied to this circuit by the same source 40 that drives the pump 10.

Pressure from the source 40 is applied at all times to a first input terminal 104 of a pneumatic AND gate 106 (a normally closed, air-piloted, spring return, three-way valve), a first input terminal 108 of a pneumatic NOT gate 110 (a normally open, air-piloted, spring return, three-way valve), a supply terminal 112 of a pneumatic memory 114 of the latch type, and a supply terminal 115 of a pump timer 116. With the circuit in this starting condition, the memory 114 is not pressurized. At the same time, no pressure is applied to a second input terminal 118 of the NOT gate 110. Accordingly, a signal is presented at an output terminal 119 of the NOT gate. This signal is a run signal applied to an input terminal 120 of a pneumatic pump timer 116.

The pump timer 116 may include a volume chamber that can be internally pressurized by the pneumatic source 40 through a connection to a supply terminal 12. Increasing internal pressure produces, as an output of the timer 116, a pump cycle signal of correspondingly increasing pressure at an output terminal 122. The timer 116 is adjustable so that an output signal of the desired pressure is generated following a selected delay after the appearance of a run signal. This output is referred to as a pump cycle signal and occurs at the beginning of each pumping interval of the pump 10. The timing function is dependent upon a ratio of surface areas, and, therefore, the duration of the time period measured is relatively independent of the pressure of the source 40. For increased accuracy, but with greater complexity and cost, a pneumatically driven clock may be substituted for the volume chamber type timer 116.

Once the pump timer 116 has timed out following the receipt of a run signal, the pump cycle signal is applied to a first input terminal 124 of an S-R (set-reset) gate 126, causing an output signal on a line 128 that results in the memory 114 being pressurized through its supply terminal 112. The memory 114 then presents the pilot signal, via a line 129, to the pilot conduit 69 through the secondary inlet 68. A pneumatic counter 138 records the number of pilot signals supplied by the line 129, thus recording the number of cycles of the pump 10 and hence the volume of fluid that has been pumped.

The memory 114 also presents the pilot signal to the second terminal 118 of the NOT gate 110, thus interrupting the run signal to the pump timer 116. Simultaneously, the pilot signal from the memory 114 is applied to an input terminal 130 of a signal timer 131. This timer 131 is also of the volume chamber type and its output signal pressure increases along with its internal pressure. The output signal is applied, via a line 132, to a second input terminal 134 of the AND gate 106. Once the signal at the second input terminal 134 reaches a predetermined comparative level with respect to the first input terminal 104, this output becomes a termination signal. The AND gate 106, operating with a snap action, then provides an output signal to a second input terminal 136 of the S-R gate 126. In response to this signal, the S-R gate 126 resets the memory 114 to a low pressure state, thus interrupting the pilot signal to the pilot conduit 68 of the pump 10 supplied via the line 129.

To understand the interaction of the pump 10 with the other elements of the pneumatic circuit of FIG. 1, the pump should be considered first in the position shown in FIG. 2 with the actuation piston 22 at the top of its stroke. The pilot valve 30 vents the contents of the lower chamber 60 and the actuation piston 22 descends. The return of the actuation piston 22 to the top of the actuation cylinder 24 is now dependent upon the pressurization of the lower chamber 60 to shift the spool 34 upwardly. Air to pressurize that chamber 60 is available only from the pilot conduit 69, which is connected via the memory output line 129 to the memory 114. Therefore, the pump 10 must pause and await the appearance of a pilot signal which is produced when the pump timer 116 times out. This pilot signal has a duration sufficient to pressurize the lower chamber and reset the pump timer 120. In essence, the frequency with which the pilot signal occurs and the corresponding length of the pumping interval are determined by the pump timer 116. The duration of that signal is determined by the signal timer 131.

It should be noted that the pneumatic circuit components that control the pumping rate are operated by the same source 40 that drives the pump 10. Nevertheless, these components are not required to carry the large volume of air that drives the pump 10. The same external pneumatic components can be used with pumps of a wide variety of sizes and air requirements. Moreover, the entire apparatus has the reliability traditionally associated with pneumatic equipment and no local electrical power supply is needed.

While a particular form of the invention has been illustrated and described, it will be apparent that various modifications can be made without departing from the spirit and scope of the invention.

I claim:

1. A pneumatic pumping apparatus having a pumping chamber, inlet and outlet valves associated with said pumping chamber, a piston reciprocable within said pumping chamber to pump a fluid into and out of said chamber, an actuation chamber, an actuation piston reciprocable within said actuation chamber and connected to said pumping piston for movement therewith, a primary inlet for admitting a pressurized gas to operate said actuation piston, pneumatic cycling means for causing said actuation piston to commence a new cycle of movement within said actuation chamber upon the application thereto of a pilot signal, and a pneumatic source connected to said inlet to supply said pressurized gas thereto, wherein the improvement comprises:

pneumatic pump timer means of the volume chamber type supplied by said pneumatic source for measuring a predetermined pumping interval and for producing a pump cycle signal at the conclusion of said interval;

pneumatic memory means supplied by said pneumatic source for presenting said pilot signal to said cycling means when pressurized;

pneumatic signal timer means of the volume chamber type responsive to said memory means for presenting a termination signal after a predetermined interval following the presentation of said pilot signal; and pneumatic S-R gate means for causing said memory means to be pressurized in response to said pump cycle signal and for causing said memory means to be depressurized in response to said termination signal.

2. A pneumatic pumping apparatus having a pumping chamber, inlet and outlet valves associated with said pumping chamber, a piston reciprocable within said pumping chamber to pump a fluid into and out of said pumping chamber, an actuation chamber, an actuation piston reciprocable within said actuation chamber and connected to said pumping piston for movement therewith, a primary inlet for admitting a pressurized gas to operate said actuation piston, pneumatic cycling means for causing said actuation piston to commence a new cycle of movement within said actuation chamber upon the application thereto of a pilot signal, and a pneumatic source connected to said primary inlet to supply said pressurized gas thereto, wherein the improvement comprises:

pneumatically operated pump timer means supplied by said pneumatic source for measuring predetermined pumping intervals and for initiating said pilot signal at the beginning of each of said intervals; and pneumatically operated means for resetting said pump timer means at the conclusion of each of said pumping intervals.

3. The apparatus of claim 2 wherein said means for resetting said pump timer means comprises a NOT gate.

4. The apparatus of claim 2 further comprising pneumatically operated signal timer means for determining the duration of said pilot signal.

5. The apparatus of claim 4 further comprising pneumatic memory means supplied by said pneumatic source and responsive to said pump timer for presenting said pilot signal and for setting said signal timer means, said memory means being responsive to said pilot signal.

6. The apparatus of claim 4 further comprising a pneumatic memory supplied by said pneumatic source for setting said signal timer in response to an output of said pump timer means and for terminating said pilot signal in response to an output of said signal timer means.

7. The apparatus of claim 6 wherein said pump timer means and said signal timer means are of the volume chamber type.

8. A pneumatic pump having a pumping chamber, inlet and outlet valves associated with said pumping chamber, a pumping piston reciprocable within said pumping chamber to pump a fluid into and out of said pumping chamber, an actuation chamber, an actuation piston reciprocable within said actuation chamber and connected to said pumping piston for movement therewith, a primary inlet for admitting a pressurized operating gas to operate said actuation piston, and pneumatic cycling means for causing said actuation piston to commence a new cycle of movement within said actuation chamber upon the application thereto of a pilot signal, wherein the improvement comprises:

pneumatically operated pump timer means for measuring a predetermined pumping interval and for initiating a pump cycle signal at the conclusion of said pumping interval; and pneumatically operated means responsive to said pump cycle signal for presenting said pilot signal to said cycling means; and pneumatically operated means for resetting said pump timer means after said pilot signal has been presented.

9. The apparatus of claim 8 wherein said pump timer means is of the volume chamber type.

10. The apparatus of claim 8 further comprising pneumatically operated signal timer means for determining the duration of said pilot signal.

11. The apparatus of claim 10 wherein said pump timer means and said signal timer means are of the volume chamber type.

12. The apparatus of claim 10 wherein said means for presenting said pilot signal includes a pneumatic memory.

13. A pneumatic pumping apparatus having a pumping chamber, inlet and outlet valves associated with said pumping chamber, a piston reciprocable within said pumping chamber to pump a fluid into and out of said pumping chamber, an actuation chamber, an actuation piston reciprocable within said actuation chamber and connected to said pumping piston for movement therewith, a primary inlet for admitting a pressurized gas to operate said actuation piston, pneumatic cycling means for causing said actuation piston to commence a new cycle of movement within said actuation chamber upon the application thereto of a pilot signal, and a pneumatic source connected to said inlet to supply said pressurized gas thereto, wherein the improvement comprises:

pneumatic pump timer means for measuring a predetermined pumping interval and for producing a pump cycle signal at the conclusion of said interval;

pneumatic pilot signal presentation means for presenting said pilot signal to said cycling means upon the appearance of said pump cycle signal; and pneumatic signal timer means for presenting a termination signal after a predetermined interval following the presentation of said pilot signal and for thereby causing said pilot signal presentation means to terminate the presentation of said pilot signal upon the appearance of said termination signal.

14. The apparatus of claim 13 wherein said signal presentation means includes a pneumatic memory and a pneumatic S-R gate to which said memory is responsive.

15. The apparatus of claim 14 wherein said S-R gate causes said memory to be pressurized in response to said pump cycle signal and causes said memory to be depressurized in response to said termination signal.

16. The apparatus of claim 14 wherein said memory and said pump timer are supplied by said pneumatic source.

17. The apparatus of claim 16 wherein said pump timer means and said signal timer means are of the volume chamber type.

* * * * *